United States Patent [19]

Weigl

[11] 4,119,322

[45] Oct. 10, 1978

[54] BRIDGE GAME FOR TWO OR THREE

[76] Inventor: William Weigl, 1805 Conwood Dr., Troy, Ohio 45373

[21] Appl. No.: 771,023

[22] Filed: Feb. 22, 1977

Related U.S. Application Data

[63] Continuation-in-part of Ser. No. 409,640, Oct. 25, 1973, Pat. No. 4,009,884.

[51] Int. Cl.[2] ..... A63F 1/02

[52] U.S. Cl. ..... 273/293; 40/384; 273/296

[58] Field of Search ..... 273/149 P, 152.1, 152.2, 273/152.41, 152.42; 40/78.15

[56] References Cited

U.S. PATENT DOCUMENTS

| | | | |
|---|---|---|---|
| 834,189 | 10/1906 | Chadbourne | 273/149 P UX |
| 1,468,613 | 9/1923 | Willink | 40/78.15 |
| 1,507,602 | 9/1924 | Heald | 40/78.15 |
| 1,527,410 | 2/1925 | Heald | 40/78.15 |
| 2,133,746 | 10/1938 | Hawgood | 273/152.41 |

*Primary Examiner*—Anton O. Oechsle

[57] ABSTRACT

Deck of playing cards for playing Bridge, with means enabling two or three players to bid competitively for an unexposed or partially-exposed dummy hand, the Aces and Kings of said deck being provided with means making their identification normally non-discernible to the naked eye, unless specially conditioned in response to a Slam bid by one of the players asking for a dummy response to signify the number of Aces or Kings contained in its unexposed cards.

16 Claims, 15 Drawing Figures

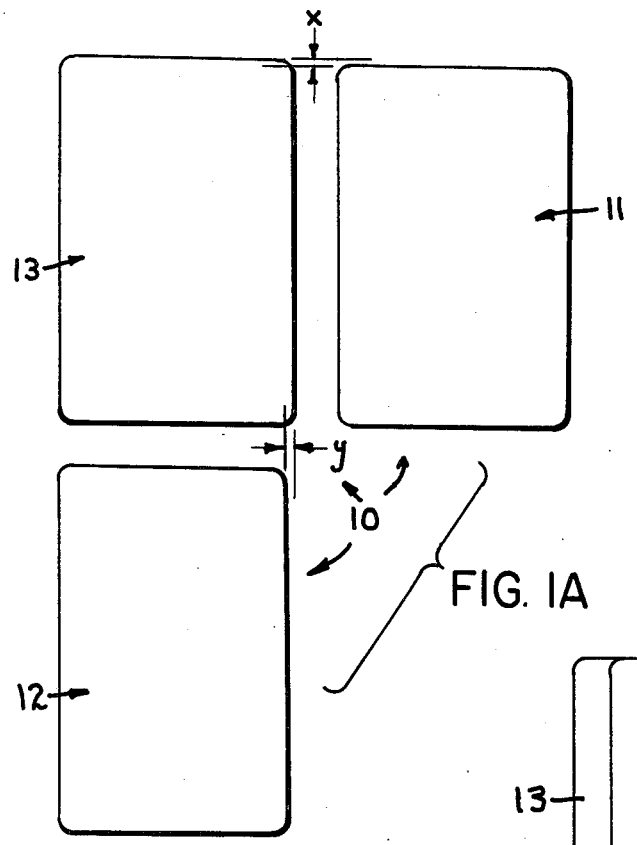
FIG. 1A
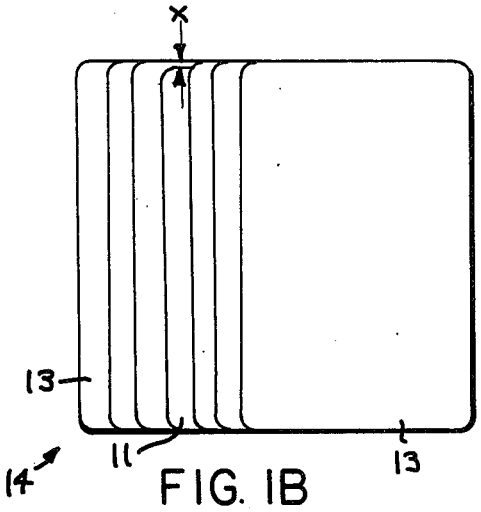
FIG. 1B
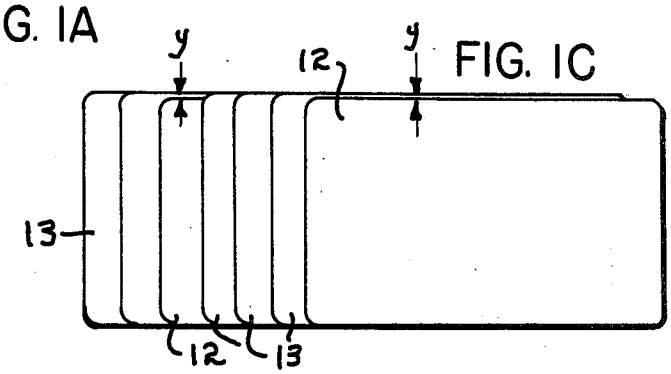
FIG. 1C
FIG. 2A
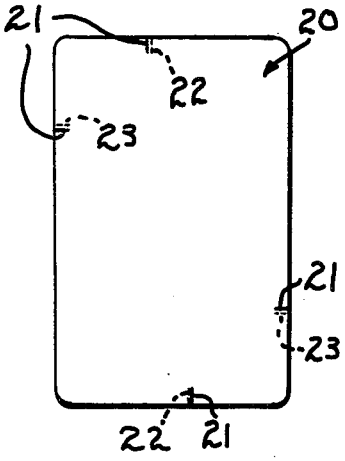
FIG. 2B
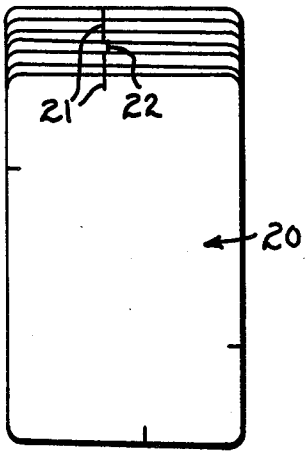
FIG. 2C
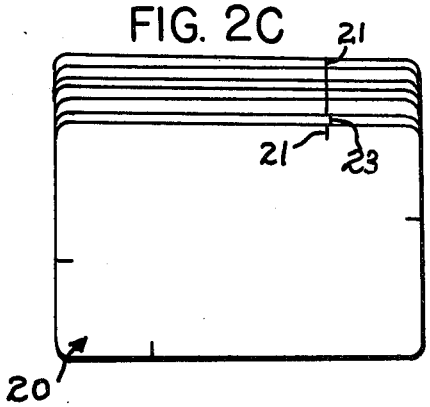
FIG. 3A
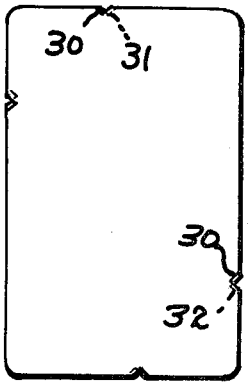
FIG. 3B
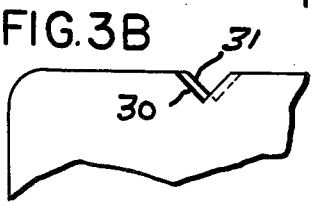

BRIDGE GAME FOR TWO OR THREE

RELATED APPLICATION

This is a continuation-in-part of my application Ser. No. 409,640, filed Oct. 25, 1973, now U.S. Pat. No. 4,009,884.

BACKGROUND OF THE INVENTION

When playing "cutthroat" bridge, wherein each of two or three players bids to make the same dummy hand his partner, or where two players bid for two different dummy hands (one to be played by each), accurate Slam bidding is presently not possible if all or any portion of the cards of the dummy hands are unexposed at the time of bidding. This is so because to bid for a Small Slam (taking of all but one of the normal thirteen tricks) or a Grand Slam (taking all tricks), it is ordinarily essential to know whether the slam bidder and his dummy partner together hold all or most of the Aces and Kings between their two hands. In other than my aforementioned. U.S. Pat. No. 4,009,884, this presently requires seeing the faces of the cards, which is undesirable from the standpoint of not being the "normal" type of bidding in the conventional game. Seeing the card faces is undesirable, because each player is then able to determine the strategic locations of all of the Aces and Kings held by his opponents and thus play his hand accordingly. The game is thus reduced to one in which bidding is based on the number of tricks which can be won and lost, rather than on the general point count and suit strength as in the standard four-handed Bridge game.

The game described in my previously-mentioned patent requires the use of a deck of cards with preprinted backs for enabling the establishing of predetermined dummy hands. This means that at the start of each deal, the backs of all 52 cards must be examined to establish the 13 card dummy. While this takes but a minute or two, some players may find it objectionable. The present invention is designed to enable random dealing of hands without required specially printed backs with indicia for selecting the hands.

SUMMARY OF THE INVENTION

This invention contemplates marking the Aces and Kings of a standard bridge deck in a fashion wherein they are visibly undistinguishable from the other cards when they are in disarray, as when dealing or holding the cards in one's hands, and are visibly or otherwise distinguishable only when unexposed cards are conditioned, such as by accurate alignment, along corresponding edges thereof.

In this fashion, they can be considered to be unmarked cards at all times except when a player bidding for the unseen cards of the dummy hand presents an artificial Slam bid such as the Blackwood or Gerber Conventions, asking the dummy to automatically reveal the number of Aces (and Kings if also called for) contained in the dummy hand. Then, by manual card alignment, the Aces and Kings, both sets of which are each marked differently to be in slight misalignment with the rest of the cards of the deck, can be distinguished to assist in the automatic response to a player's Slam bid.

THE DRAWINGS

FIG. 1A illustrates a form of my invention in which the Aces and Kings are marked by trimming a small unnoticeable amount from the edges thereof.

FIGS. 1B and 1C illustrate the manner of aligning the cards of a dummy hand of FIG. 1A to separately distinguish the Aces and Kings respectively along different edges of the deck.

FIGS. 2A–2C illustrate a printed form of identification means accomplishing the same end results as the embodiment of FIGS. 1A–1C.

FIGS. 3A and 3B show a notched species of the register means of the invention.

DESCRIPTION OF PREFERRED EMBODIMENTS

Figure 4A:
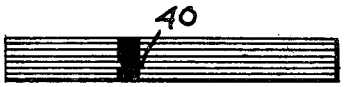
FIGS. 4A and 4B illustrate another printed modification of the invention, wherein the identification means if provided on the card edges.

Referring now to that form of the invention illustrated in FIGS. 1A thru 1C, the backs of the 52 cards 10 of a bridge deck may be imprinted or printed in a manner where the printing is kept away from the edges. The cards are of the four suits of Spades, Hearts, Diamonds and Clubs, each suit having the customary 13 cards of Ace, 2, 3 . . . through King.

As is well known in the playing of the four-handed game of Bridge, each of two teams of two players bids to play a certain hand in a selected suit or at "No Trump" and contracts to take a specified number of the thirteen tricks which constitute that entire hand. The players put forward artificial bids such as "One Club", "One No Trump", "Two Spades", etc., each providing information attempting to identify the relative card strength and supporting suits of the bidder's hand to his partner, in an attempt to achieve a final bid best suited to the bidding team's two hands. At a point in the bidding where one team recognizes that its two partners jointly have considerable strength, a Slam Convention bid may be entered by one of the players, asking for a very specific answer by his teammate as to the number of Aces the teammate has in his hand. The most commonly used Slam bid is called the Blackwood Convention, in which the player desiring to know the number of Aces held by his partner, bids Four No Trump. At that point, the partner's response must be quite specific: if he holds no Aces, he must answer Five Clubs; if one Ace, Five Diamonds; if two Aces, Five Hearts; and three Aces, Five Spades. (If he holds all four Aces, he also responds Five Clubs, and his partner can normally tell from looking at his own hand whether Five Clubs means no Aces or four Aces.) Another similar Slam Convention bid is known as the Gerber Convention, which enables a similar type of bidding at a lower level.

If the party bidding the Blackwood Convention is satisfied that a Small Slam (taking twelve of the thirteen possible tricks) is in the offing and wants to examine further whether the partnership has enough Kings to go all the way for a Grand Slam (taking every trick), he may again bid, this time entering the artificial bid of Five No Trump. The responder follows automatically as with the call for Aces, but this time at the Six level, no (or four) Kings being shown by an automatic bid of Six Clubs, etc., as with the Aces. Having received the precise response as to how many Kings are held by his partner, it is the slam bidder's obligation to enter the final partnership contract bid according to the information obtained.

What has been described above is not possible when two or three players bid competitively for an unexposed dummy hand in a "cutthroat" game, because the silent dummy can't divulge how many Aces or Kings are contained therein. And, if the dummy hand were "open", i.e., fully exposed, the bidding loses its "chance" element, and is not really true Bridge. As a compromise, however, some "cutthroat" games have been played by exposing approximately half of the dummy hand and leaving the remainder unexposed during bidding. Any unexposed dummy cards leave Slam bidding extremely hazardous and chancy, however, and remove from the game one of its greatest thrills, the taking of all or all but one of the tricks, through a Grand Slam or Small Slam, respectively.

My invention is designed to accomplish Slam bidding with an unexposed or partially exposed dummy hand, by enabling Aces and Kings to be distinguished from the other cards of the dummy hand, providing certain conditions are met, namely, in a preferred form of the invention, by aligning the unexposed cards of the dummy hand. This can be done by three people bidding for a single dummy two people bidding for one dummy with another 13 cards being set aside in a "dead" or unplayable hand, or two people each bidding for their own dummy partner (and ideally not being able to view the other player's dummy hand.) It is accomplished with the cards 10 of FIG. 1A by trimming about 3/64ths of an inch from the tops of the four Aces 11 and the same amount from the sides of the four Kings 12. The remaining forty-four cards 13, 2 through Queen in each of the four suits, are full size, the relative differences between the various cards being shown by the dimensions "*x*" and "*y*" in FIG. 1A.

If a dummy hand 14, seven cards of which are shown in FIG. 1B, is required to answer to a player's Blackwood bid of Four No Trump, the unexposed cards would be aligned at their bottom edges on the surface of a table or merely aligned by hand, and the dimension "*x*" becomes apparent for only one card. Close examination is necessary, however. Thus, the unseen dummy automatically bids Five Diamonds, meaning it contains one Ace. (Of course, if there are one or more Aces in the already exposed cards of the dummy hand, the bid is increased accordingly.) If the player feels content to explore the possibility of a Grand Slam, he can then go forward, bidding Five No Trump, in effect telling the dummy to reveal how many Kings it contains. By now aligning the same unexposed dummy cards along their sides as in FIG. 1C, two Kings are revealed by the distinguishable misalignment "*y*" and the dummy's automatic response is Six Hearts. The bidder must then take the remaining bidding from there on his own. Notice that the two Kings 12 of FIG. 1C showed up as general cards 13 of standard height in FIG. 1B, and the Ace of FIG. 1B showed up as a general card 13 of standard width in FIG. 1C. This desirable so that a bidder who is hesitant to ask for Kings with a Five No Trump bid does not obtain that information while identifying the Aces at the lower bid level.

The dimensional differences resulting from the trimmed edges "*x*" and "*y*" are so slight as to not be discernible when the cards are in disarray, as when being dealt or when being held in a player's hand. It even requires close viewing when aligned as in FIGS. 1B and 1C. In this fashion, although the Aces and Kings are truly marked cards, their markings are normally not visible by either player, and are distinguishable only when accurately aligned or otherwise conditioned for identification.

In another modification of the invention, alignment markings are provided on the backs of the cards of a deck 20 to accomplish with printed register marks what has been accomplished by different card dimensions in FIGS. 1A–1C. The cards are all the same size. Mark 21 indicates the card is a "two through Queen", mark 22 designates an Ace, and mark 23 designates a King. It shall be understood that Aces and Kings also have marks 21 along the edges at right angles to the edges containing marks 22 and 23. By referring to FIGS. 2B and 2C, which constitute aligned unexposed cards of a dummy hand, Aces and Kings contained therein are revealed.

FIGS. 3A and 3B are registered or conditioned similar to that of FIGS. 2A–2C, but notches are used instead of printed marks. Notches 30, 31 and 32 are found on the twos thru Queens, Aces and Kings, respectively. Instead of fanning the cards, they are aligned on all edges for inspection, preferably holding one's fingers over the notches not being inspected.

Figure 4B:
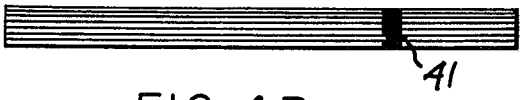

FIGS. 4A and 4B illustrate still another version of alignment means, this time the markings being on the edges rather than the backs of the cards. Either narrow or wide marks may be utilized. FIG. 4A shows that the dummy contains one Ace 40, and FIG. 4B shows one King 41 as being present in the unexposed cards of the dummy hand.

Figure 5B:
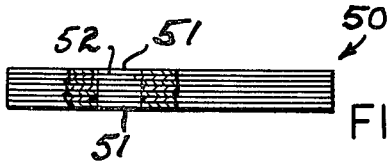
FIGS. 5A–5C illustrate yet another modification of the invention, which requires use of an auxiliary device to condition the cards.
Figure 5A:
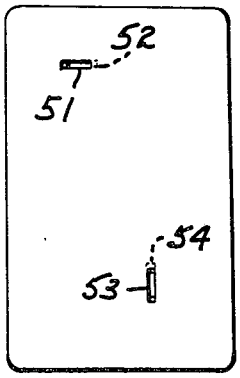
Figure 5C:
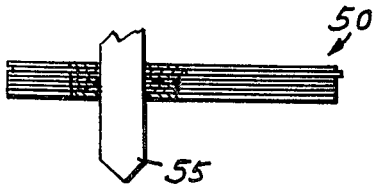

A mechanical register modification is illustrated in FIGS. 5A–5C in which the deck 50 has slots 51 and 52 to distinguish Aces from the rest of the deck, and slots 53 and 54 to distinguish the Kings. I prefer that only one set of slots be used for each, thus requiring that the cards of the dummy first be oriented as shown in FIG. 5A before responding to a Slam bid. FIG. 5B shows the dummy cards aligned, but at this point, there is no way of knowing how many Aces are contained; athough if there are none, the slots 51 will align perfectly and a Five Club response is indicated by dummy. If there is slot misalignment, however, a thin bar 55 which is dimensioned to accurately fit the slots is inserted therein as shown in FIG. 5C to condition the cards for identification. This immediately shows one card protruding beyond the others, indicating one Ace.

Kings would be similarly indicated by using pin 55 in slots 53 and 54 of the dummy hand.

Figure 6A:
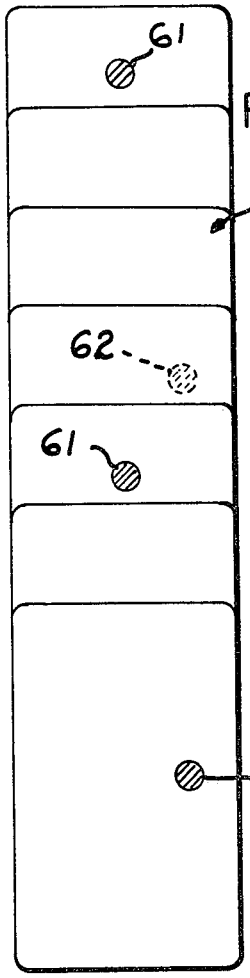
FIGS. 6A–6B illustrate still another version of the invention wherein the identification means involves the use of invisible printing and employs light of a specified sprectrum to show up the Aces and Kings.
Figure 6B:
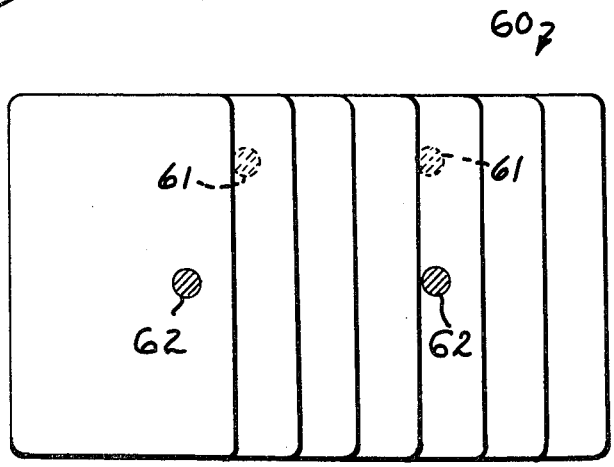

The invention may also be practiced without registration of the cards. For example, FIGS. 6A and 6B show cards 60 with spots or other marks 61 and 62 for identifying Aces and Kings respectively. The marks may be of invisible ink or other colorless actinic ray-absorbing material, for example, viewed under ultraviolet light. Spots 61 and 62 should be so located and the cards fanned as in FIGS. 6A and 6B to avoid viewing both simultaneously. Or, two different types of coatings and lights of different spectrums may be used for Aces and Kings. Where a single coating and light is used, note that one of the Kings, the top card, is found while inspecting for Aces in FIG. 6A.

While I have illustrated that the Aces and Kings are detected alongadjacent edges of the deck, they can be located on opposed ends or sides, for example, by the backs of the cards having printing which definitely distinguishes tops and bottoms. The cards would first be arranged the same way before inspection for Aces and Kings.

I have illustrated that card marking may be accomplished in a great number of ways, it being important only that the marking be readily discernible to the players only where a Slam Convention bid is made and a dummy response is required.

Various other modifications may be made without departing from the spirit and scope of the invention.

Having described my invention, I claim:

1. In a bridge deck of 52 playing cards used in a bridge game in which two or three players bid to contract for a dummy hand which is incapable of verbal response and at least some of the cards of which dummy are unexposed to the players at the time of bidding, means associated with only the Aces of said deck, which means is normally non-discernible to the naked eye of the players, for distinguishing, in response to an artificial Slam bid by one player and in further response to conditioning said cards to so distinguish, said Aces from the remaining cards of the deck without viewing the faces of the cards to reveal the number of Aces contained in any unexposed portion of said dummy hand.

2. In a bridge deck according to claim 1, second means associated with only the Kings of said deck, which means is normally non-discernible to the naked eye of the players, for distinguishing, in response to a second artificial Slam bid by said one player and in further response to conditioning of said cards to so distinguish, said Kings from the remaining cards of the deck without viewing the faces of thecards to reveal the number of Kings contained in the unexposed portion of said dummy hand.

3. A bridge deck according to claim 1 wherein said conditioning is responsive to registering means for aligning the unexposed dummy cards along corresponding edges thereof to reveal misregister of the Aces relative to the remaining cards.

4. A bridge deck according to claim 3 wherein said conditioning is further responsive to a second registering means for aligning the unexposed dummy cards along different edges than those for distinguishing the Aces, to reveal misregister of the Kings relative to the remaining cards.

5. A bridge deck according to claim 1 wherein said conditioning is responsive to an auxiliary device associated with said deck.

6. A bridge deck according to claim 5 wherein said distinguishing means comprises openings in each of the cards of said deck, and wherein said auxiliary device comprises a tool insertable through said openings to cause misregister of said Aces from the remaining cards of said dummy hand by planar displacement thereof and visual protrusion beyond an edge of said dummy hand.

7. A bridge deck according to claim 5 wherein the backs of said Aces are coated with a medium non-discernibly visibly distinguishable from the remaining cards of said deck, an wherein said auxiliary device comprises means for discerning the Aces through means of said coated backs.

8. A bridge deck according to claim 4 wherein said distinguishing means is located at the edges of said cards.

9. A bridge deck according to claim 4 wherein said distinguishing means comprises a different measurement of said Aces relative to the rest of the cards of the deck across one dimension and a different measurement of said Kings relative to the rest of the cards of the deck across a second dimension at right angles to said one dimension.

10. A bridge deck according to claim 9 wherein both of said different dimensions are smaller than the corresponding dimensions of the rest of the cards of the deck.

11. A bridge deck according to claim 3 wherein said registering means comprises notches in the edges of said cards.

12. A bridge deck according to claim 3 wherein said registering means comprises printed marks on the backs of said cards adjacent the edges thereof.

13. A bridge deck according to claim 3 wherein said registering means comprises printed marks on the edges of said cards.

14. In a bridge deck of 52 playing cards used in a bridge game in which two or three players bid to contract for a thirteen card dummy hand which is incapable of verbal response and at least some of the cards of which dummy are unexposed to the players at the time of bidding, the improvement comprising:

means associated with the Aces of said deck and signifying the number of Aces in the unexposed cards of said dummy hand in response to a Slam bid by one of said players calling for such number of Aces.

15. In a bridge deck according to claim 14 including means associated with the Kings of said deck and signifying the number of Kings in the unexposed cards of said dummy hand in response to a further Slam bid by said one player calling for such number of Kings.

16. A bridge deck according to claim 15 wherein the backs of said cards are all similar in appearance, requiring that the hands be randomly dealt.

* * * * *